US005440993A

United States Patent [19]

Osofsky

[11] Patent Number: 5,440,993

[45] Date of Patent: Aug. 15, 1995

[54] HIGH VELOCITY IMPULSE ROCKET

[76] Inventor: Irving B. Osofsky, 28327 San Nicolas Dr., Rancho Palos Verdes, Calif. 90274

[21] Appl. No.: 13,239

[22] Filed: Feb. 3, 1993

Related U.S. Application Data

[63] Continuation of Ser. No. 624,089, Dec. 7, 1990, abandoned.

[51] Int. Cl.[6] ..... F42B 15/10

[52] U.S. Cl. ..... 102/374; 60/253; 102/283; 102/347

[58] Field of Search ..... 60/251, 253; 102/283, 102/285–292, 372, 373, 374, 376, 443, 347; 149/21

[56] References Cited

U.S. PATENT DOCUMENTS

| | | | |
|---|---|---|---|
| H403 | 1/1988 | Glasser | 102/374 |
| 49,773 | 9/1865 | Lugo | 102/443 |
| 1,468,822 | 9/1923 | Ludorf | 102/376 |
| 1,879,579 | 9/1932 | Stolfa et al. | 60/253 |
| 3,298,182 | 1/1967 | Webb | 60/251 |
| 3,561,362 | 2/1971 | Black et al. | 102/374 |
| 3,628,457 | 12/1971 | Magnusson | 102/374 |
| 3,698,321 | 10/1972 | Wall | 102/374 |
| 3,938,440 | 2/1976 | Dooley et al. | 102/430 |
| 4,104,969 | 8/1978 | Moll | 102/374 |
| 4,311,005 | 1/1982 | Hurd, Jr. et al. | 60/253 |
| 4,519,855 | 5/1985 | Lenevew et al. | 102/288 |
| 5,081,930 | 1/1992 | Williams | 102/292 |

FOREIGN PATENT DOCUMENTS

| | | | |
|---|---|---|---|
| 2028539 | 8/1978 | Germany | 60/253 |
| 157714 | 3/1922 | United Kingdom | 102/374 |

*Primary Examiner*—Harold J. Tudor
*Attorney, Agent, or Firm*—Beehler & Pavitt

[57] ABSTRACT

An improved high energy impulse rocket includes a motor case containing propellant composed of individual, free flowing granules of a predetermined shape and unbonded to said motor case. The propellant has a high burning rate of 100 milliseconds or less and generates chamber pressures of up to about 50,000 psi. The rocket motor includes a reentry nozzle open at one end and connected to an exit nozzle, the reentry nozzle forming an annulus to contain the propellant and also forming a barrier to prevent ejection of the propellant during burning. Acceleration of the rocket assists in maintaining the propellant within the motor case, which acceleration may be as high as 20,000 g generating a velocity as high as 10,000 fps. Such a rocket offers unique advantages, especially as a device to punch an opening in a wall structure, the details of which are described as well as other details of the improved and relatively inexpensive impulse rocket.

23 Claims, 5 Drawing Sheets

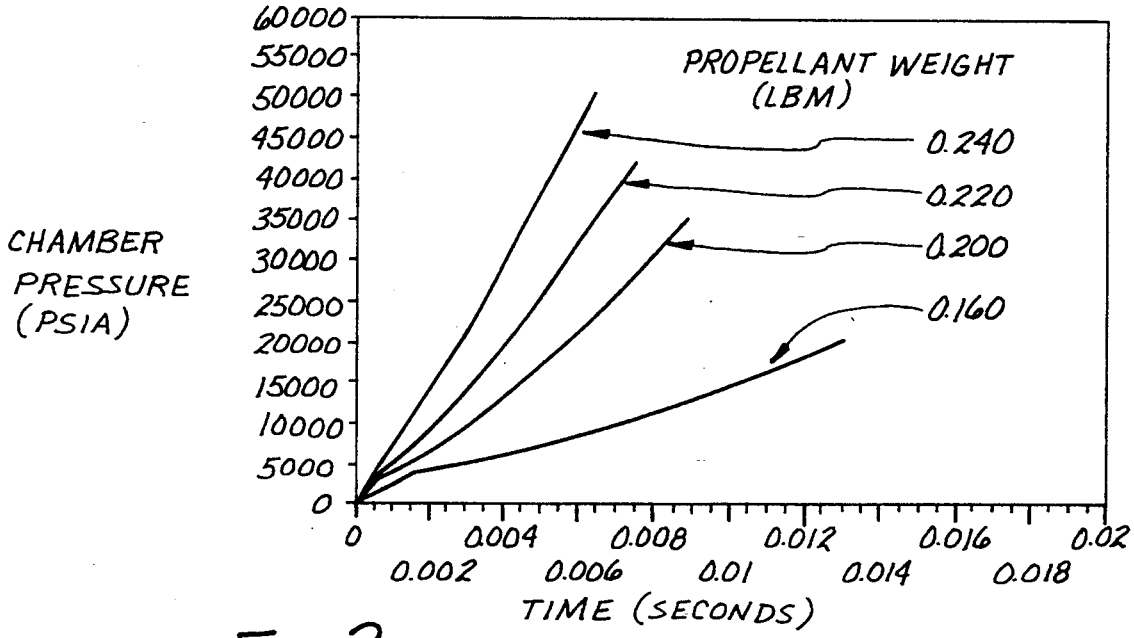
Fig. 3
Fig. 4
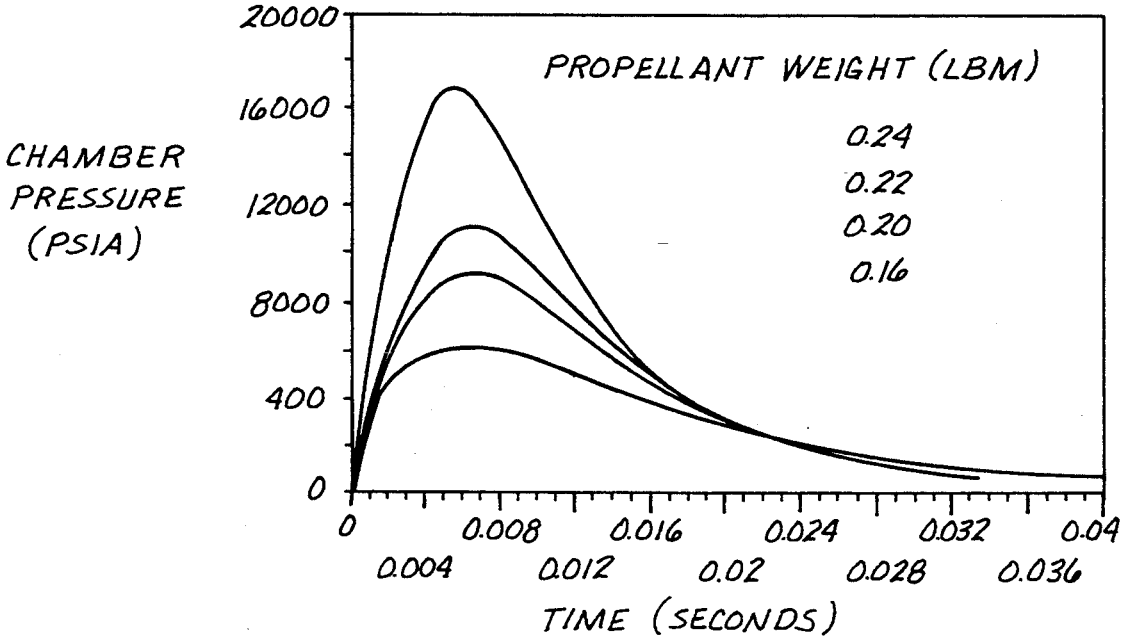

Fig. 5
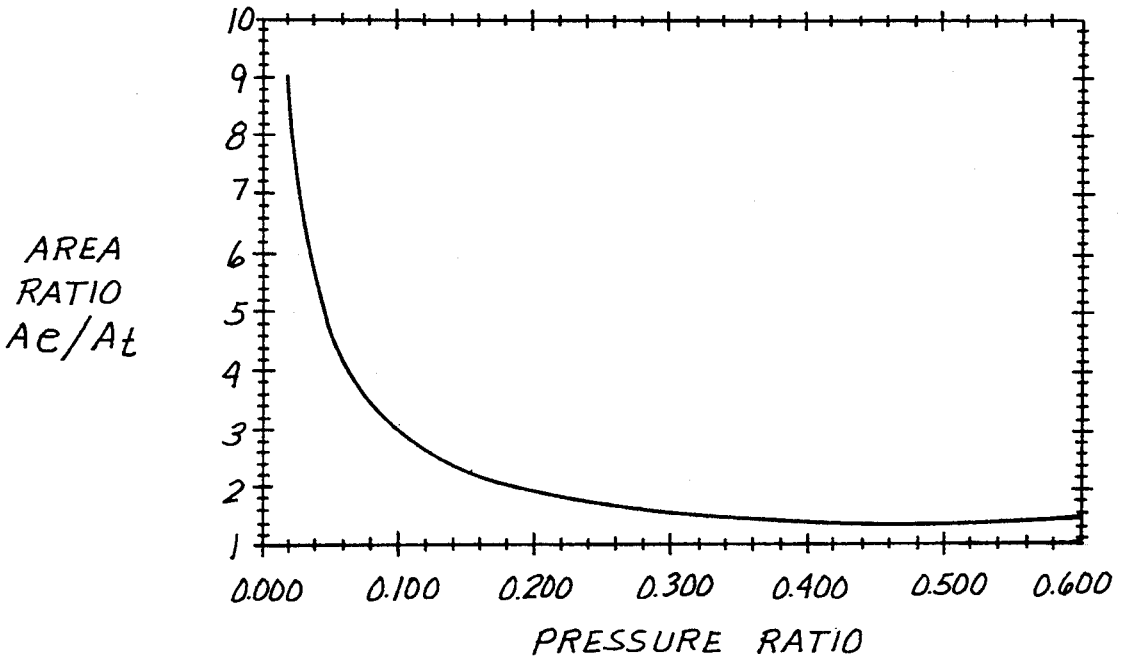
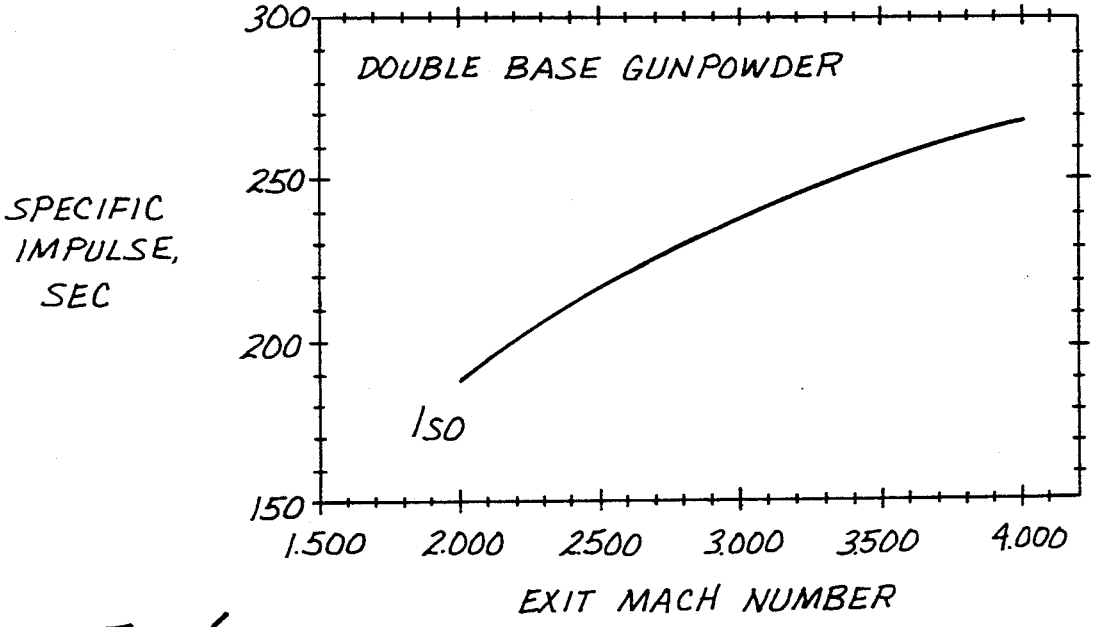
Fig. 6

HIGH VELOCITY IMPULSE ROCKET

RELATED APPLICATIONS

This application is a continuation of application Ser. No. 07/624,089, filed Dec. 7, 1990, now abandoned and assigned to the same assignee.

FIELD OF INVENTION

The present invention relates to a high velocity rocket and more particularly to an improved high velocity impulse rocket motor of unique design and capable of carrying a payload or projectile and using conventional gun propellants to obtain very short burning times at chamber pressures which are quite high as compared to conventional rocket motors and which has axial acceleration characteristics far greater than conventional rocket motors,

BACKGROUND OF THE INVENTION

Conventional rocket motors use a propellant grain which is normally cast in place. The burning surface of the grain is the exposed surface of the cast grain and is limited by the grain geometry. Structural integrity of the grain is affected directly by rocket acceleration which tends to crack the grain, deflect it and separate the grain from the case wall at the bond line. The motor case may have a rubber type of liner bonded to its interior with the propellant grain, in turn, bonded to the liner.

Conventional rockets are stress limited to maximum accelerations of about 500 g and minimum burn times of about 0.5 seconds. For example, large ABM rocket motors such as HiBex have been built with a propellant burning rate of 4 inches per second at 2,000 psi. Small scale experiments have shown that a burning rate of 12 inches per second is possible, however, the burning rate affects volumetric loading efficiency and does not affect grain stress. HiBex test vehicles have reached a velocity of 5,000 fps in 0.8 seconds at a range of about 1,100 feet and attained a maximum velocity of about 9,000 fps in 1.125 seconds at a range of 3,000 feet with a 750 g maximum acceleration at burnout.

In these "conventional" rocket motors, a single hollow cast propellant grain, approximately the consistency of rubber, is bonded to the motor case or to a synthetic rubber liner which in turn is bonded to the motor case and only the inner surface of the grain burns. The propellant grain is put under high stress due to its inertia during rocket acceleration and due to internal pressure expansion of the motor case which tends to crack the grain and separate it from the case wall. In the ABM rocket motors, the thick grain must withstand axial acceleration in the order of 750 g's. The overall propellant stresses and strains govern acceptable motor case and propellant thickness which result in motor mass fractions of approximately 0.8. Space rockets may have a mass fraction of 0.9, mass fraction being generally defined as the weight of propellant divided by the launch weight of the rocket.

There are several methods of increasing rocket motor performance with the current state of the art technology. One approach is to design a motor in which the nozzle is part of the propellant grain resulting in higher mass fractions due to the reduction of motor hardware weight. This solution does nothing for the propellant-/bond stress and strain problem and does not decrease motor burn time.

Another aspect of rocket motor design and the problems with prior motor designs is related to the use of a rocket motor as a device to deliver accurately to a target a kinetic energy penetrator or other type of payload at a relatively high and preferably hypersonic velocity. A typical such device is an anti-tank impulse rocket or one used to deliver a high energy penetrator to a reinforced structure such as a building or bunker or to deliver a battering ram type of device to building for rapid access thereto (the battering ram requires velocities only in the 1,000 ft/sec regime but burnout distances are restricted to 5 feet or less so that the battering ram can be placed in restricted areas).

For example, current antitank rockets are generally subsonic rockets with burning times of greater than one second. These are high explosive rounds with maximum ranges on the order of one or two miles at maximum velocity. The velocity of the explosive warhead antitank rocket does not add to the penetration effectivity.

Where the mission requirement requires close in use, then the rocket system should have a burn time in the order of milliseconds to achieve a kill velocity, e.g., 6,000 fps, at point blank range. An explosive warhead would probably injure or kill the launching personnel at target ranges less than 50 feet. Thus for example, calculations (assuming a constant acceleration) indicate that the burn time is between 10 to 100 milliseconds to reach a target with a velocity of 6,000 fps where the target ranges are from 20 to 300 feet. Conventional and known rocket motors have not been able to achieve these velocities in a short burn time.

Such relatively short burn times produce a weapon that can get to a distant target in a very short time so that allowance for target motion is minimized in ranges in the order of 1,000 meters. It is known, for example, that the flight error is related to burn time. Thus, a shorter burn time to achieve a relatively high velocity tends to reduce flight error. Assuming a rocket travel of 1,000 meters in 0.55 seconds, a tank travelling normal to the line of sight of the rocket launch position at 20 mph (32 km/h) would move only 18.8 feet after firing and before being hit by a 6,000 fps munition. Because such an impulse rocket accelerates to full velocity in less than 50 feet, minimal or no allowance need be made for wind drift and weathercocking angle of attack.

It is also apparent that not all impulse rockets need the high velocity normally required for tank armor penetration. The velocity of the impulse rocket of this invention may be between 500 and 10,000 fps in 100 milliseconds or less. There are instances in which it is desired to use a rocket device, close in, in order to deliver a debilitating gas to the interior of the structure or to form an opening in a structure without creating a fire and without injuring those in the structure, i.e., a hostage assault and recovery operation. In this instance, the velocity of the rocket should be less than 6,000 fps so as to prevent the payload from passing all the way through the structure-from one side to the other. Typically a velocity of between 1,000 to 2,000 fps and as high as 5,000 fps is adequate for these purposes, depending on the needs of the mission. Particularly advantageous is the relatively short burn time and the achievement of a relatively high velocity in a short travel interval to provide a high energy impact. The energy of impact is related to the kinetic energy, i.e., $\frac{1}{2}(\text{mass} \times \text{velocity}^2)$. In this instance, the rocket motor is no longer burning when the projectile impacts the wall and thus, even if the rocket and projectile enter the structure after taking out a wall or forming an opening therein, there is no possibility of a rocket induced fire within the structure.

It is thus apparent that a need exists for an efficient rocket motor with burn times of less than about 0.010 seconds.

It is equally apparent that a need exists for a high energy impulse rocket, i.e., a rocket system that develops a large kinetic energy over a relatively short period of time.

It is also clear that a need exists for an improved rocket motor in which grain cracking, grain stress, and grain strain no longer limit motor acceleration while at the same time providing a mass fraction as high as possible to obtain maximum velocity with minimal weight and size.

There are distinct advantages to be achieved and significant cost reductions if, for example, cast or preformed propellants and bonding of the same to the rocket motor case can be avoided. These and other practical advantages to be discussed, take on added significance if the rocket motor can achieve short burn times in the range of up to about 100 milliseconds and which can accelerate at g levels ranging from 5,000 g to 20,000 g.

It is also desirable to provide a high velocity impulse rocket which can be fired from a launch tube or other device such as a gun barrel, and which may be mounted or hand held.

Moreover, there are unique advantages to a high velocity, low cost impulse rocket system for use as a sounding rocket, and a low cost orbital insertion system for small payloads. Such systems, in accordance with this invention, may also be used for research requiring high speeds in the atmosphere and on rocket sleds. In addition, the rocket booster of this invention may be used on naval vessels to fire anti-aircraft and anti-missile projectiles without generating a long visible visual or radar/IR trail leading to the ship or launch installation and thereby enhance defense against airborne attack vehicles.

BRIEF DESCRIPTION OF THE INVENTION

The present invention provides a unique high velocity impulse rocket motor capable of relatively short burning times, at relatively high motor chamber pressures, e.g., 50,000 psi, and which achieves rather high accelerations and high kinetic energy in a short burn period.

In accordance with this invention, a unique high velocity impulse rocket motor is provided which is relatively inexpensive, capable of hypersonic velocities in a very short flight time, and which uses a propellant totally different from that used in conventional rockets. The term "impulse" rocket is intended to refer to a rocket motor which develops a large force or high kinetic energy over a short period of time. The result is a unique high velocity rocket which avoids the prior problems with "structured" propellant grains, achieves high effective propellant burn rates at relatively high chamber pressures and at relatively low burn times, to provide uniquely high velocities at short ranges at propellant burn out.

The unique impulse rocket of this invention uses principally conventional gun and cannon propellants in the form of flowable preformed particulate powder granular elements which are non-bonded to each other or to the motor case. These powders, even in preformed particulate granular form have short burn times without very high burning rates, generate relatively high pressures and generally do not suffer the structural problems associated with cast or bonded propellants. One of the advantages is that the powder material, in the form herein contemplated, is "insensitive ammunition" as compared to conventional rocket propellants because there is insufficient critical mass in any one propellant granule to respond to particle impact by detonation and the individual particulate granular elements will not likely generate a high pressure wave which will cause detonation of the entire powder charge.

The motor itself is uniquely configured to house and effectively permit the propellant to function as a power source even though the latter is in particulate granular form, free flowing and not bonded to the motor case. Apart from the nature of the payload, which varies widely, the motor is relatively simple but quite efficient and unique in operation.

The motor casing is structured to contain a high burning rate granular propellant and basically includes a supersonic nozzle and means to permit flow of propulsion gases through the nozzle while providing a barrier, cooperating with the relatively high acceleration forces, to prevent the granular propellant from being blown out the nozzle. The rocket of this invention includes a slightly diverging reentry nozzle which also forms the barrier and which terminates in a diverging discharge nozzle through which the gases flow to create thrust. Between the reentry nozzle and the motor casing is an annulus which receives the particulate, granular, non-bonded and free flowing propellant. The reentry nozzle includes an open throat on or near the forward end and is thus in gas communication with the annulus so that combustion gases flow from the annulus, through the throat and the reentry nozzle and out the discharge end. An igniter of any suitable type may be used to ignite the powder propellant charge. Typically the igniter will be inserted into the nozzle exit cone and will be held in place by shear pins, adhesive or some other fastening means that will keep the igniter in place, blocking gas flow, until the chamber pressure rises to a predetermined value at which time the igniter will be ejected from the nozzle.

Upon ignition, the propellant powder grains in the annulus near the inner open end of the reentry nozzle will ignite, start pressurizing the chamber and nozzle with hot gas, eject the igniter which may be located in the reentry nozzle, exhaust pressurized hot gas through the reentry nozzle, and accelerate the missile. As the rocket accelerates, the flames will continue to spread through the particulate powder propellant along the entire length of the motor case. Inertia forces from acceleration will maintain the granular powder propellant towards the aft end of the motor case and only gases will exit through the discharge end of the nozzle. Because the propellant is not a monolithic structure bonded to the motor case wall but is in the form of loose individual and non-bonded granules, the acceleration stresses are compressive and do not tend to split the individual granules thus causing a sudden change in the burning area.

Due to the nature and type of the propellant, burn times of less than 100 milliseconds are achieved, at relatively high chamber pressures, with the result that there is an appreciably high acceleration in a relatively short time. In effect, the impulse rocket motor of this invention achieves a higher kinetic energy in a shorter burn time with mass fractions of as high as 0.8 and at higher chamber pressures than conventional rockets.

One of the significant advantages of the very fast response impulse motor of this invention lies in decreased cost. The propellant grains essentially are the mass produced granular propellants used in artillery shells and the charge cost would be reduced to about $5.00 to $10.00 per pound in finished and loaded form. Because the propellant is loaded in the form of free flowing non-bonded granular pellets, no large and complex casting and curing facilities are required and the grain/liner/case bonding procedures are eliminated along with processing inspection. Temperature and humidity control requirements for the rocket motor of this invention are similar to those specified for conventional artillery ammunition. Moreover, empty rocket motor cases could be made and stored in normal warehouses, transported empty and loaded in or near the field if desired. The rocket case may be substantially cylindrical or spherical, as will be described.

The performance of the rocket of this invention may vary in terms of velocity at burnout depending on the mission needs. For antitank use, velocities of 6,000 fps are typical using a pointed depleted uranium or tungsten rod penetrator. In the case of battering ram applications, a lower velocity at burnout may be used, as is also the case for a rocket delivery for incapacitating materials.

As is apparent, since it is relatively easy to vary the propellant charge composition, grain size, grain shape and grain perforations, differing performance modes are readily and easily achieved.

Another advantage of the very short millisecond range burn time is that the internal heating and erosion of the motor case and nozzle is negligible and inexpensive materials may be used for the nozzle throat and expansion cone.

It is also apparent that this improved impulse rocket motor provides a variety of possible design configurations depending on the needs of the mission. Staged rocket configurations are possible with relatively low cost propellants in a unique rocket motor of unusually high velocity, in which a plurality of rockets may be sequentially and time sequence fired upon separation or separated by aerodynamic drag with subsequent serial firing of the non-separated stage(s) to provide unusually high thrusts in a short burn time. One advantage is the reduction of continuous tell tale flame profiles and attendant IR signatures. Small thrust rockets of short burn time and high specific impulse are easily configured and of small volume, relatively safe for space travel. Due to the relatively high thrust, reduced cost and short burn time, the uses of the impulse rocket of this invention as reverse thrust rockets for high performance aircraft and space vehicles is also technically attractive.

It will thus be apparent from the following detailed description that various forms of the present invention may be practiced. The following description is intended for purposes of illustration only and is not intended to be a limitation on the present invention.

DETAILED DESCRIPTION OF THE DRAWINGS

FIG. 1 is a view partly in section and partly in elevation of one form of the improved rocket motor and delivery system in accordance with the present invention;

FIGS. *2a*, *2b* and *2c* are diagrammatic illustrations of the granular powder propellant in accordance with this invention;

FIG. 3 is a plot of time versus chamber pressure for a progressive burning propellant;

FIG. 4 is a plot similar to that of FIG. 3 of a progressive/regressive propellant;

FIG. 5 is a plot of the area ratio versus the pressure ratio;

FIG. 6 is a plot of the net specific impulse versus exit Mach number;

DETAILED DESCRIPTION OF THE INVENTION

Figure 1:
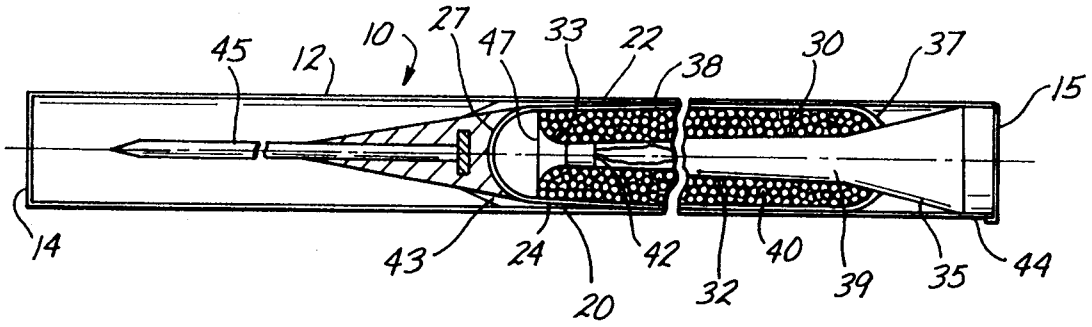

Referring to the drawings which illustrate a preferred form of the present invention, FIG. 1 illustrates an impulse rocket powered antitank weapon 10 in accordance with this invention, although it is understood that the invention is not limited thereto. As illustrated for purposes of explanation, the system includes a launch tube 12 which is cylindrical in shape and closed at the forward end by a frangible cover 14 and at the aft end by a blowout cap 15. The launch device may also be what is called a zero length launch tube which is essentially a tripod type structure on which the rocket is mounted.

Supported within the launch tube 12 is a rocket motor and payload 20, the rocket motor 22 including a motor case 24 including a forward dome or head section 27 which may be hemispherical and which forms the forward motor case closure. The payload may be any one of a variety of payloads, such as a kinetic energy penetrator, an explosive warhead, an electronics package, a debilitating gas warhead or a chemical/bacteriological warhead, or in some applications, no warhead at all. The forward motor case closure may have a threaded plug for charging the motor with propellant. Located within the motor case 24 is a nozzle assembly 30, the latter including a supersonic reentry small angle diverging section 32 at the forward end, a reentry nozzle throat 33, spaced from the head and a larger angle supersonic exit nozzle 35 at the aft end. The nozzle assembly 30 is sealed to the aft dome 37 of the motor case, as shown, at approximately where the exit nozzle 35 joins with the reentry nozzle. As shown, the reentry nozzle has a diameter which becomes progressively larger towards the aft end 39, but is of smaller diameter than the exit nozzle.

Between the nozzle assembly 30 and the inner wall 38 of the motor case is an annulus 40, the latter extending from the aft dome to the forward dome, as shown. The aft end of the annulus is closed while the forward end is opened. Received within the annulus is the granular propellant having spaces between the granules for passage of the ignition gases. The propellant will be described in more detail later.

In effect, the motor is uniquely structured and configured to provide a barrier which prevents the granular propellant from being discharged out of the exit nozzle during propellant combustion. The barrier is formed in the embodiment illustrated by the reentry nozzle which also forms a flow path for the combustion gases to the exit nozzle. The rocket motor is also structured and configured uniquely to accept a granular propellant with a burning rate which generates chamber pressures of up to 50,000 psi and to be described, and which is retained in the rocket motor during the burn time. It is this combination of a propellant in the form of individual granules and the means to retain the individual granules of high rate burning propellant within an accelerating rocket motor, capable of very short burn times with conventional propellant, and capable of generating high motor chamber pressures and thus high specific impulse which forms the marked improvement of this invention.

By comparison, the same propellant granules or composition contained within a cartridge casing of conventional artillery (20 to 120 mm complete shells), or as bags within a conventional gun loaded with the same (105 or 155 mm howitzer or larger bore guns) is ignited within the gun bore. The rapid combustion generates high internal pressure on the order of 50,000 psi which propels the projectile out of the bore at muzzle velocities of 2,800 ft/sec. In contrast, in accordance with this invention, essentially the same propellant is used and is carried with the rocket in short burn time and the accompanying time of flight. Typically, the burning rate for gun propellants is on the order of 1.5 to 2 inches/-second at maximum pressures of 50,000 psi as compared to rocket propellant which has a burn rate ranging to 4 inches/second at 3,000 psi. The burn time for the impulse rocket is similar to burn times obtained in guns with the same propellant. In contrast, it is believed that conventional solid rocket motors use monolithic pressed or cast single grain propellants. These munitions typically rely on relatively low chamber pressure propellants.

Received within the forward end of the reentry nozzle is an igniter 42, although it may be located elsewhere such as in the aft end of the reentry nozzle, inboard of the exit nozzle, within the exit nozzle or at the motor header. The igniter may be of various types, well known in the art, and is sealed to the receiving structure by shear pins, threads or a shear ring not shown. A preferred igniter is one that is electrically fired although percussion activated devices may be used.

The rocket motor and payload is supported within the launch tube at the forward end by a multipart separating sabot 43, for example, with an aft support 44 at the aft end. Mounted on the forward end of the motor case is the payload 45 which, in the form illustrated may be a pointed depleted uranium or tungsten penetrator. The interior of the motor also optionally includes a screen 47 extending across the open end of the annulus and the open end of the forward nozzle assembly, as shown. The screen functions to prevent expulsion of the granules during handling and assists in preventing the propellant granules from being blown out the reentry nozzle.

The overall operation of the system of FIG. 1 is as follows. Upon firing of the igniter, the propellant grain is ignited and commences burning. As the pressure builds up to a self-sustaining value, the igniter is blown out the aft end by shearing of the pins, threads or shear ring and the missile starts to accelerate due to pressure acting on the nozzle. The flow of gases initially is from the forward end of the annulus, into and through the reentry nozzle and out the end nozzle. During pressurization and acceleration, flames spread through the propellant along the entire motor case. Inertia forces from the acceleration keep the propellant grain down in the annulus, towards the rear dome 37 due to the high thrust induced axial acceleration of the rocket in free flight. During acceleration, each individual grain feels only compression stresses due to chamber pressure and the amplified weight of the grain and the weight of other grains above it in the acceleration field. This compression stress is somewhat relieved by the flotation of the propellant in the dense gas and by the aerodynamic drag forces from the forwardly flowing gases in the annulus. Local failure of a small number of grains by cracking upon deflecting due to stress will not be disastrous because of the huge burning surface already exposed. The increase in surface area due to deflection and cracking is relatively small.

The propellant in accordance with this invention is a conventional granular gun propellant which is commonly available. In general, it may be a common double based smokeless powder granules qualified at pressures from 600 psi to 50,000 psi, with a burning rate of 0.95 in/second at 2,000 psi, for example. The propellant may be a non-metallized propellant whose main ingredients are nitroglycerin (30% to 45%) and nitrocellulose (50% to 60%) by way of example. The propellant is also characterized as being non-bonded in the sense that the granules are not bonded to each other and being free flowing granules unbonded to the case. The shape may vary, being substantially cylindrical or spherical and the propellant may have internal perforations and/or external ridges.

Figure 2C:
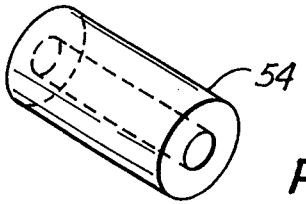
Figure 2B:
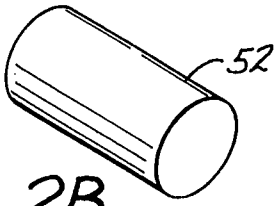
Figure 2A:
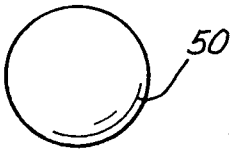

FIG. 2*a* illustrates a spherical grain propellant 50 while FIG. 2*b* illustrates a cylindrical propellant grain 52. FIG. 2*c* illustrates a hollow cylindrical propellant grain 54. The spherical and cylindrical shapes give a regressive pressure curve because the exposed area decreases rapidly with time. The propellant may also be of the progressive type in which the burning area increases as the granules burn. The propellant may also be a progressive/regressive propellant as will be described. If pellets or granules are inhibited on selected surfaces or a hollow granule is used, neutral or near neutral pressure curves may be achieved. Granule sizes are principally a function of allowable chamber pressure and desired burning time. The cylindrical propellants are manufactured by continuous extrusion through a die and then cut to lengths. The spherical granules are made by a somewhat different process, also well known. Typically, for a burn time of 100 milliseconds at a chamber pressure of 5,000 psi, the propellant granule may be about 0.10 inches in diameter or length and for burn times at 100 milliseconds at a chamber pressure of 25,000 psi, the propellant granule may be about 0.25 to 0.50 inches in diameter or length.

Loading of the rocket motor is relatively simple and involves weighing out a charge on a precision balance and pouring the individual granules into the annulus. The screen may be used to hold the granules in place to prevent falling into the nozzle assembly during handling after loading. Smaller propellant granules may be used between larger ones in order to make more efficient use of space, shorten initial pressure response time and enhance mass fraction. For spherical propellant granules of one size, the packing density is about 65% of available volume. For randomly oriented cylindrical granules, the packing density is somewhat less. It is also possible to preweigh and prepackage various types of propellant granule charges depending upon the desired performance of the motor.

Typical commercially available propellants are those available from Hercules Incorporated under the designation HPC60, HPC86 and HPC96. These granular propellants are double based materials whose principal ingredients are nitroglycerin, nitrocellulose and barium nitrate. It is apparent that other granular propellants may be used. It is preferred in accordance with this invention to use a progressive/regressive propellant because the propellant can be used without exceeding case pressure capabilities. A progressive propellant configuration, however, provides a shorter burning time. The differences are illustrated in FIGS. 3 and 4.

FIGS. 3 and 4 show typical plots of calculated chamber pressure versus time for a progressive granular propellant (HPC60) and a progressive/regressive granular propellant (HPC86). In each of the figures, there are several curves which illustrate the effect of propellant weight on produced case pressure. The progressive nature of a progressive propellant is shown in FIG. 3 wherein there is a constant increase in pressure to the point of burnout. The progressive/regressive nature of a progressive/regressive propellant is illustrated in FIG. 4 wherein there is a classical increase of pressure to a maximum and a subsequent decay in chamber pressure.

The motor case and nozzle assembly are preferably made of a material having a high strength/weight ratio in order to withstand the relatively high internal chamber pressures and to increase the mass fraction. Typical such materials are high strength resin matrix graphite and glass fiber composites, 6-4 titanium alloy, 17-4 PH precipitation hardening steel or 300 grade maraging steel. The graphite and fiberglass composites are, however, preferred because the resulting motor case will weigh less for the same chamber pressure.

The exit nozzle is a supersonic nozzle and the expansion ratio of the nozzle plays an important role in the performance of the rocket. FIG. 5 is a plot of the nozzle ratio, Ae/At as a function of the pressure ratio, Po/Pe. In this plot, the nozzle exit diameter is limited to the diameter of the motor case and thus it is important to use high chamber pressures to achieve reasonable expansion ratios.

FIG. 6 is a plot of specific impulse as a function of exit Mach number. The delivered specific impulse depends on exit Mach number plus the static pressure difference (Pe-Pa) at the nozzle exit. Exit Mach numbers are limited by nozzle diameter for a rocket motor that must fit within a launch tube or gun barrel. The delivered specific impulse may be increase further by using a higher energy granular propellant and/or by adding a metal such as aluminum to the propellant composition.

The performance of the unique motor of this invention is affected by the specific impulse and the nozzle throat/exit expansion ratio, as is apparent from the following table based on a 155 mm anti-tank impulse rocket:

| Penetrator Weight lbs. | Specific Impulse Is sec. | Propellant Weight lbs. | Motor Weight lbs. | Total Weight lbs. | Rocket Velocity fps |
|---|---|---|---|---|---|
| 5 | 240 | 12 | 4 | 23 | 5,175 |
| 5 | 250 | 12 | 4 | 23 | 5,319 |
| 5 | 260 | 12 | 4 | 23 | 5,606 |
| 7.5 | 240 | 18 | 5 | 32.5 | 5,855 |
| 7.5 | 250 | 18 | 5 | 32.5 | 6,099 |
| 7.5 | 260 | 18 | 5 | 32.5 | 6,343 |
| 10 | 240 | 25 | 6 | 43 | 5,936 |
| 10 | 250 | 25 | 6 | 43 | 6,184 |
| 10 | 260 | 25 | 6 | 43 | 6,431 |

Figure 7:
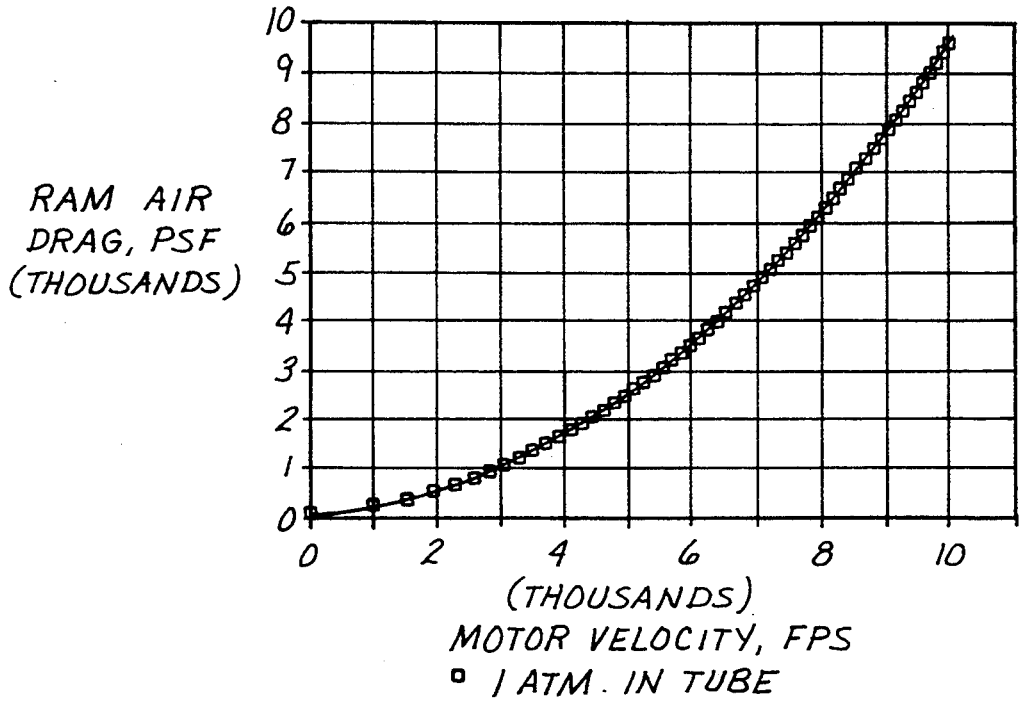
FIG. 7 is a plot of tube rocket air drag versus velocity.

The impulse rocket accelerating down a launch tube is dynamically similar to the classic piston in a tube discussed in texts of gas dynamics. Based on these classical relations, calculations were made to determine the pressure acting on a rocket as it accelerates down a closed tube. The data presented in FIG. 7 indicate that an anti-tank rocket accelerating down a launch tube would experience a ram drag pressure of about 3,600 psf. For an 8 inch diameter rocket this is approximately 1,250 pounds of drag force. To reduce the tube drag, the launch tube optimally should be a skeletonized framework or an open perforated tube which could dump the pressure faster than it builds up. In flight, the rocket would experience mostly wave drag.

Figure 8:
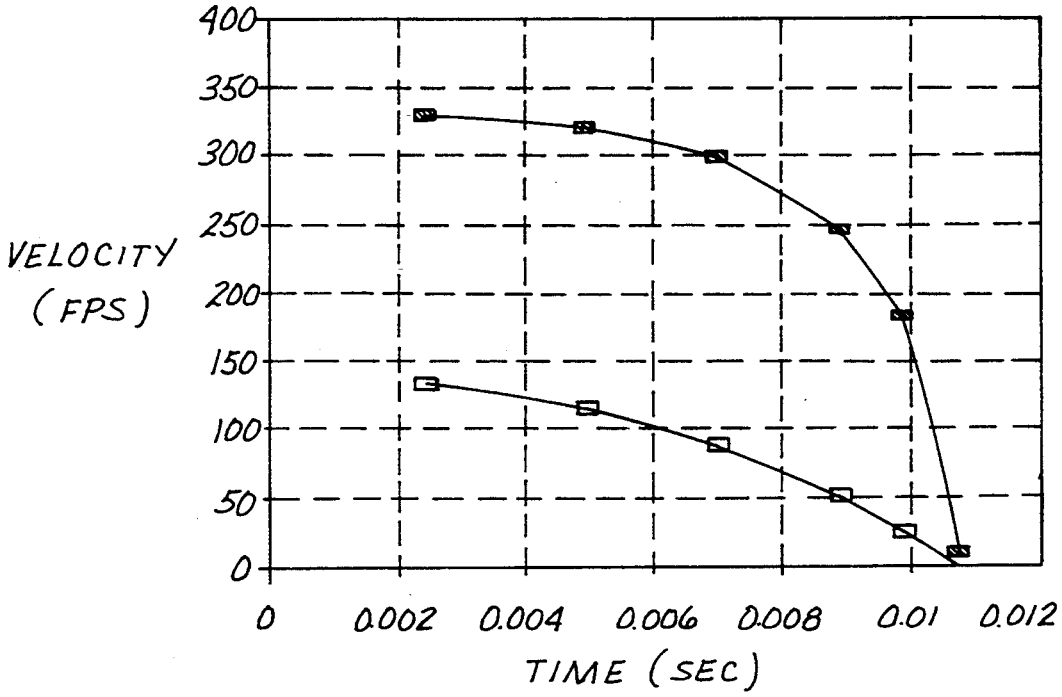
FIG. 8 is a plot of velocity versus time illustrating the velocity variation between the gas and the granular propellant.

FIG. 8 presents data in which the velocity of the pressurized chamber gas required to float the propellant granule is compared to the actual gas velocity in the rocket chamber as a function of time. If the actual velocity is greater than the calculated flotation velocity, the propellant would be ejected from the chamber with the gasses during the burning process. If the upward drag force, i.e., that urging the granules forward to the nose, caused by the propellant gas flow exceeds the inertia force due to acceleration, the granules will be dragged along with the gas and blown out during the burning process. The flotation velocity is defined as the gas velocity such that the aerodynamic drag force equals the inertia force on the granules. The data compare the flotation velocity that the granules encounter as a function of time. The data, as presented in FIG. 8 indicate that the float velocity is always greater than the gas velocity for the accelerations noted and thus, the propellant granules will not be dragged out with propulsion gases to be prematurely ejected through the motor through the nozzle throat.

Dynamic test firings of rocket motors in accordance with this invention established that the improved impulse rocket motor assembly did in fact perform as expected. The rocket of this invention may not be static test fired since the absence of acceleration would cause the granular propellant to be blown out the exit nozzle. Theoretically, a screen over the nozzle throat or over the upper propellant annulus would allow static firing but at this time such a screen has not been deemed practical to install because of thermal, stress and pressure loss problems.

Figure 9:
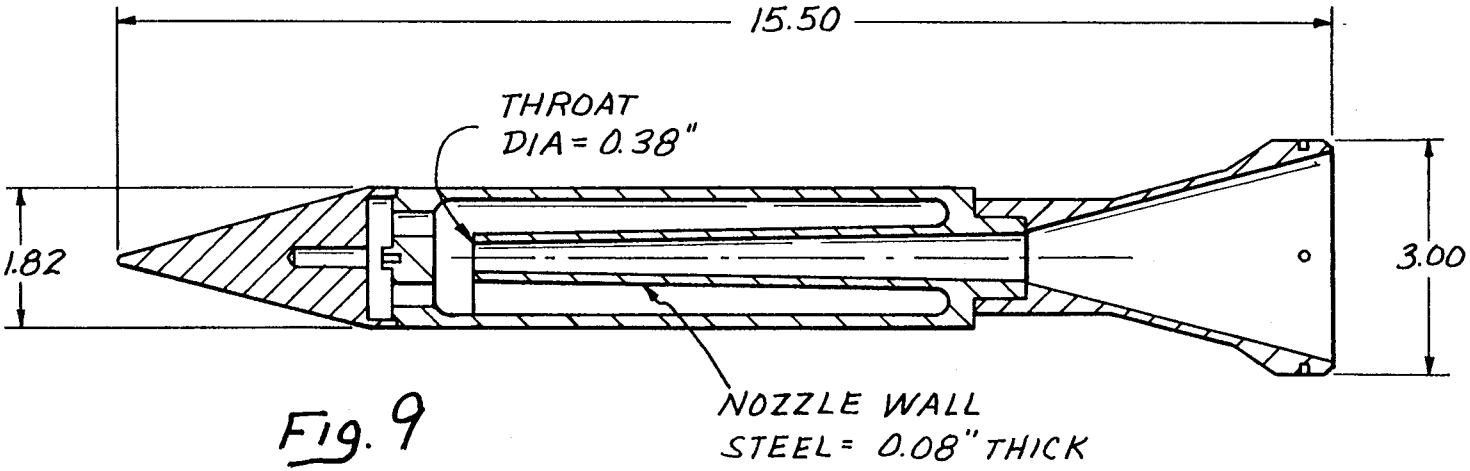
FIG. 9 is a sectional view of a rocket motor in accordance with this invention which was actually test fired.

The structures dynamically tested included four rocket motor assemblies of the dimensions illustrated in FIG. 9 and each was a much simplified structure over that previously described. The motor cases were maraging steel bar, heat treated to an ultimate strength of 280–300 ksi. The aft section was made of 6061 aluminum alloy and its outer diameter was designed to act as a bore rider in the launch tube and as the igniter retainer.

On the tube launched impulse rockets, the exit nozzle outer diameter is designed to act as both a bore rider in the launch tube and as the igniter retainer. A nylon nose cone, rather than the penetrator previously described, supported a three piece separating nylon bore riding sabot to keep the rocket centered in the launch tube. A standard exploding bridgewire igniter mounted in the motor exit nozzle was used and was designed to separate when the motor pressure rose to a predetermined level. Aerodynamic forces separated the sabot from the rocket upon exit from the launch tube. Each motor was loaded and fired twice into a target. The propellant granules were the HPC60 and HPC86 materials mentioned. The weight of propellant varied from 0.140 lbs to 0.245 lbs. While the predicted burnout time was between 7.5 and 45.8 milliseconds, the actual burnout time was less than 7 milliseconds, with an estimated burnout distance of between 11 and 25 inches of travel. The actual specific impulse was in the range of between 200 and 270 seconds.

High speed movies showed that the rockets flew to the target with no observable oscillation in yaw or pitch, and entered the target axially with a clean round hole. Test observations indicated that all of the propellant burned in the rocket in a very short time and distance and there was no evidence that any propellant granules had been blown out. Acceleration using the propellant noted was calculated to be about 10,000 g for the system tested, but actual acceleration was measured at 5,700 to 8,000 g which was adequate to retain the propellant in the motor. Examination of the motors after all of the firings showed no thermal discoloration or erosion. At firing, a large rearward flame was observed thus requiring that the rear of the launch tube be kept clear of personnel. In the case of firing from a gun tube, blast shields may be required for personnel protection.

As previously discussed, the improved impulse rocket of this invention may be used to provide a battering ram rocket motor for assault and hostage release operations which require effective entry into a building structure by forming an opening through which personnel may enter. The improved impulse rocket of this invention is specifically adapted for that type of operation for several reasons. First, the relatively short burn time assures that at the time of penetration there will be no flame to ignite the structure penetrated. Secondly, the tremendous energy of the system is fully capable of use close in to the structure and delivers an enormous impact. Velocities of 1,000 to 3,000 fps or more in 30 to 50 feet are easily achieved. In fact, the velocity needed to penetrate a structure may be determined at the site and the appropriate charge may be loaded at the site.

Figure 10:
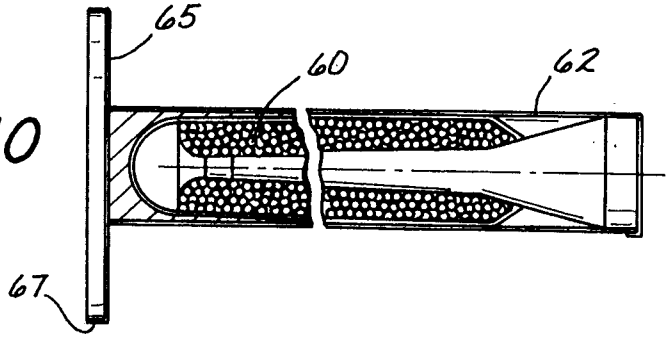
FIG. 10 is a diagrammatic view of a rocket battering ram structure in accordance with this invention.

FIG. 10 is a diagrammatic sketch of an impulse motor battering ram structure. The rocket motor 60 is as previously described. The launch tube 62 is as previously described. The payload 65 in this case is of larger diameter than the launch tube or the rocket since it is desired to impact the target structure with sufficient force over a sufficient area to blow a large hole in the structure for troop entry, preferably without harming any of those present within the structure. In the form illustrated the ram is a flat circular plate mounted on the motor and may include a cutting lip 67 to sever any reinforcing bars. If desired, the plate may be configured to improve its aerodynamic configuration for longer flight times or to improve the force of impact or the extent of penetration, depending upon the need. The plate may be pivotally mounted on the rocket if desired. The plate may be replaced by a series of radial blades extending outward from the rocket chamber to shear a path through the structure and any reinforcement bars. Alternatively, a circular cookie cutter can be attached to the outer periphery of the cutting blades to shear a disk shaped plug through the wall. The rocket launcher may be tripod mounted and fired from a remote location.

It is also possible to mount the plate 65 on the structure and fire a rocket at the plate in which the payload of the rocket is a blunt impact head which drives the plate through the wall.

Figure 11:
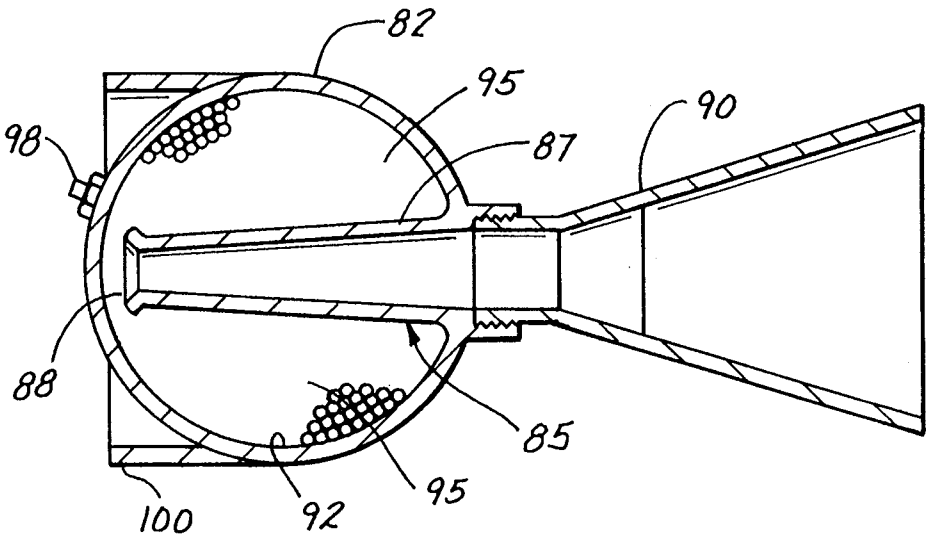
FIG. 11 is a diagrammatic view of a spherical rocket motor in accordance with this invention.

FIG. 11 illustrates a spherical rocket 80 in accordance with this invention. Within the spherical motor case 82 which may be of the materials described, is the nozzle assembly 85, the latter including a supersonic reentry small angle diverging section 87 at the forward end, a reentry nozzle throat 88, as already described, and a larger angle supersonic exit nozzle 90 at the aft end. The nozzle assembly 85 is sealed to the aft dome of the motor case, as shown, at approximately where the exit nozzle 90 joins with the reentry nozzle. As shown, the reentry nozzle has a diameter which becomes progressively larger towards the aft end, but is of smaller diameter than the exit nozzle.

Between the nozzle assembly 85 and the inner wall 92 of the motor case is an annulus 95, the latter extending from the aft dome to the forward dome, as shown. The aft end of the annulus is closed while the forward end is opened. Received within the annulus is the granular propellant having spaces between the granules for passage of the ignition gases. The propellant is as previously described.

The motor case 82 is provided with a fill port 98 for loading of the granular propellant. Optionally mounted on the motor case 82 is a force attachment device 100, generally circular in shape and on which a battering ram device may be mounted. Other payloads may also be mounted on this form of rocket motor of this invention. One advantage of the spherical rocket is that it has a larger profile and thus impacts over a greater surface area when used in a battering ram mode. Another advantage of the spherical motor is that its mass fraction is lower than the mass fraction of any other shape.

It is apparent that the rocket of this invention is not limited by size and may reach accelerations of 10,000 fps in a very short time interval. In large measure this is due to the high burning area of the granular propellant and the high chamber pressures which may reach as high as 50,000 psi. Also a factor is that the mass fraction may be as high as 0.8.

It is thus apparent that the improved high velocity impulse rocket system of the present invention offers unique performance and significant versatility with respect to payload and ease of assembly and reduced costs. It will be apparent that various modifications may be made by those skilled in the art based on the detailed description herein which modifications are deemed to come within the scope of the present invention as set forth in the appended claims.

What is claimed is:

1. A high velocity impulse rocket, comprising:

an outer rocket motor case, a reentry nozzle within said outer rocket motor case and forming an annulus therebetween, said reentry nozzle terminating in a discharge nozzle for exit of propulsion gases, a head member in said outer rocket motor case and spaced from said reentry nozzle, said reentry nozzle being in gas communication with said annulus whereby propulsion gases in said annulus flow in a first direction opposite said discharge nozzle, said head member and reentry nozzle being operative to cause the propulsion gases to flow in a reverse direction from said first direction and towards said discharge nozzle, a propellant in said annulus, means to ignite said propellant, said reentry nozzle and said head member and said propellant cooperating to generate a pressure within said outer rocket motor case after ignition of said propellant of between 5,000 and 50,000 psi, said propellant being composed of individual, free flowing granules of a predetermined shape unbonded to said outer rocket motor case whereby upon ignition of said propellant the gases flow from said annulus in said first direction tending to blow said propellant out of said discharge nozzle and then in said reverse direction to said reentry nozzle and out of said discharge nozzle for accelerating said rocket, and said propellant having a granular flotation velocity which is greater than the gas velocity for maintaining said propellant within said annulus during combustion thereof.

2. A high velocity impulse rocket as set forth in claim 1 further including a payload carried thereon.

3. A high velocity impulse rocket as set forth in claim 1 having a mass fraction of up to about 0.8.

4. A high velocity impulse rocket as set forth in claim 1 wherein said propellant has a burn time of 100 milliseconds or less.

5. A high velocity impulse rocket as set forth in claim 1 wherein said rocket achieves a velocity of between 500 and 10,000 fps in 100 milliseconds or less.

6. A high velocity impulse rocket as set forth in claim 1 wherein the propellant granules are restrained from being ejected through the reentry nozzle by screen means whereby said granular propellant is retained within said annulus during combustion thereof.

7. A high velocity impulse rocket as set forth in claim 1 wherein said rocket has mounted on it a kinetic energy penetrator.

8. A high velocity impulse rocket as set forth in claim 1 wherein said rocket has mounted on it a wall penetrating means.

9. A high velocity impulse rocket as set forth in claim 1 wherein said granular propellant is composed of granules of the same size.

10. A high velocity impulse rocket as set forth in claim 1 wherein said rocket carries a payload which is larger in diameter than the diameter of the outer rocket motor case.

11. A high velocity impulse rocket as set forth in claim 1 wherein said rocket is spherical in shape.

12. A high velocity impulse rocket system, comprising:

a high velocity impulse rocket, which includes:

an outer rocket motor case including a head, said outer rocket motor case including reentry nozzle means within said outer rocket motor case and said reentry nozzle means terminating in an exit nozzle for combustion gases, said outer rocket motor case and said reentry nozzle means forming an a propellant receiving chamber therebetween, a propellant in said propellant receiving chamber between said outer rocket motor case and said reentry nozzle means, means to ignite said propellant, said propellant being composed of individual, free flowing granules of predetermined configuration unbonded to said outer rocket motor case, said propellant having a granular flotation velocity which is greater than the gas velocity for maintaining said propellant within said chamber during combustion thereof, said propellant generating a pressure within said outer rocket motor case after ignition thereof of between 5,000 and 50,000 psi, and means in said outer rocket motor case permitting flow of the combustion gases in a first direction away from said exit nozzle and then in an opposite direction out of said outer rocket motor case to said exit nozzle while preventing discharge of said granular propellant out of said exit nozzle whereby upon ignition of said propellant the gases flow from said outer rocket motor case and out of said exit nozzle for accelerating said rocket and for maintaining said propellant within said outer rocket motor case,

13. A high velocity impulse rocket system as set forth in claim 12 wherein said means in said outer rocket motor case includes said reentry nozzle means, the latter having an open front end and an aft end connected to said exit nozzle for flow of combustion gases therethrough, said reentry nozzle means being in spaced relation to said outer rocket motor case to form an annulus therebetween, and said propellant being located in said annulus.

14. A high velocity impulse rocket system as set forth in claim 12 wherein said high velocity impulse rocket further includes a payload carried thereon.

15. A high velocity impulse rocket system as set forth in claim 12 wherein said high velocity impulse rocket has a mass fraction of up to about 0.8.

16. A high velocity impulse rocket system as set forth in claim 12 wherein said propellant has a burn time of 100 milliseconds or less.

17. A high velocity impulse rocket system as set forth in claim 12 wherein said high velocity impulse rocket achieves a velocity of between 5,000 and 10,000 fps in 100 milliseconds or less.

18. A high velocity impulse rocket system as set forth in claim 12 wherein said high velocity impulse rocket is supported in a launch tube.

19. A high velocity impulse rocket system as set forth in claim 12 wherein said high velocity impulse rocket has mounted on it a kinetic energy penetrator.

20. A high velocity impulse rocket system as set forth in claim 12 wherein said high velocity impulse rocket has mounted on it a wall penetrating means.

21. A high velocity impulse rocket system as set forth in claim 12 wherein said granular propellant is composed of granules of the same size.

22. A high velocity impulse rocket system as set forth in claim 12 wherein said high velocity impulse rocket carries a payload which is larger in diameter than the diameter of the outer rocket motor case.

23. A high velocity impulse rocket system as set forth in claim 12 wherein said rocket motor case is spherical in shape.

* * * * *